United States Patent [19]

Ginsberg

[11] 4,084,271

[45] Apr. 18, 1978

[54] STEAM BATH DEVICE FOR SHOWER

[76] Inventor: Irwin L. Ginsberg, 1236 Glenview St., Philadelphia, Pa. 19111

[21] Appl. No.: 758,747

[22] Filed: Jan. 12, 1977

[51] Int. Cl.[2] ..... A61H 33/06

[52] U.S. Cl. ..... 4/161; 128/367; 239/282; 239/446

[58] Field of Search ..... 4/145, 146, 150, 160, 4/161, 162, 163, 164; 128/366, 367; 239/282, 283, 289, 443, 444, 446, 447, 597

[56] References Cited

U.S. PATENT DOCUMENTS

| | | | |
|---|---|---|---|
| 1,652,437 | 12/1927 | Handelan | 4/162 |
| 2,024,930 | 12/1935 | Judell | 4/145 |
| 2,588,255 | 3/1952 | Larsh | 239/444 |
| 2,621,078 | 12/1952 | Wahlin | 239/597 |
| 2,753,433 | 7/1956 | Rutkowski | 4/161 |
| 3,112,073 | 11/1963 | Larson et al. | 239/446 |
| 3,375,532 | 4/1968 | Gellman | 4/145 |
| 3,936,891 | 2/1976 | Kulde | 4/160 |

*Primary Examiner*—Richard E. Aegerter
*Assistant Examiner*—Richard R. Stearns
*Attorney, Agent, or Firm*—Caesar, Rivise, Bernstein & Cohen, Ltd.

[57] ABSTRACT

Apparatus for use in a shower stall to simulate a steam bath. In one embodiment the apparatus comprises a diverter valve adapted to be connected between a conventional shower head in the stall and the pipe carrying hot water thereto. A flexible conduit is connected to the diverter valve and includes nozzle means disposed at the free end thereof. The nozzle means includes an orifice producing an aerosol mist of a multitude of fine droplets of hot water in a well defined flat pattern. The nozzle means is mounted with respect to the walls to cause the spray pattern to impinge the wall at an angle and produce a cloud of fine hot water droplets simulating live steam. The nozzle is constructed to produce a large volume of water droplets from a small volume of hot water.

In another embodiment the nozzle is permanently mounted within the stall via a pipe extending through the wall of the stall and in fluid communication with a hot water pipe of the building in which the stall shower is located.

4 Claims, 11 Drawing Figures

STEAM BATH DEVICE FOR SHOWER

This invention relates generally to steam baths and more particularly to a unit for use in a stall shower to simulate the effect of a live steam bath.

Various devices have been proposed in the patent literature for converting a tub or shower into a steam bath. While some of the devices disclosed in the patent literature appear to be effective to produce simulated live steam, such devices nevertheless exhibit various drawbacks.

For example, in U.S. Pat. No. 1,652,437 (Handelan) there is disclosed a vapor bath attachment for bath tubs. The attachment includes a shroud or closure in the form of a flexible cover made of a rubberized or waterproof fabric and adapted to be pivoted over the rim of a bath tub to provide an enclosure. An opening is provided in the cover so that a person can sit in the tub with his body within the enclosure and with his head outside. A vapor producing nozzle extends into the tub and is adapted to convert hot water from the conventional faucet into a finely divided vapor and discharge it into the enclosed tub.

While the device of Handelan appears operative to produce a simulated steam bath, it is clear that the device is cumbersome and confining. In addition, the positioning of the vapor producing nozzle may present a scalding hazard to the user.

In U.S. Pat. No. 2,753,433 (Rutkowski) there is disclosed apparatus for converting a stall shower into a steam bath. The device includes electrical immersion heater means for producing the steam. Needless to say, the necessity for electrical means to produce the steam in the Rutkowski device renders it of limited use.

In U.S. Pat. No. 3,557,389 (Scobey) there is disclosed a steaming unit for connection between a water pipe and a conventional shower head of a stall shower. The device of Scobey makes use of immersion heating means to effect the creation of live steam. Accordingly, the Scobey device is of limited utility.

In U.S. Pat. No. 3,936,891 (Kulde) there is disclosed apparatus for converting a conventional shower into a massage sauna. To that end, the apparatus is adapted for connection to a conventional shower head via a diverter valve. A conduit is connected to the diverter valve and at the free end of the conduit is provided a pair of arcuate spray arms. The arms include plural spray orifices and are adapted to support a body-enclosing cover or shroud. In use the person sits within the shroud with his head extending through an opening provided at the upper portion thereof. Needless to say, the device of Kulde suffers from many of the drawbacks of the prior art devices, such as the Handelan device. In addition, since the arcuate arms include a plurality of orifices, it would appear that the device of the Kulde patent could not be used for an extended period of time without exhausting the home's supply of hot water.

Accordingly, it is a general object of the instant invention provide an apparatus for simulating a live steam bath in a stall shower and which overcomes the disadvantages of the prior art.

It is a further object of the instant invention to provide apparatus which can be readily connected to existing stall showers to simulate a steam bath.

It is still a further object of the instant invention to provide apparatus which can be built into new construction to enable a stall shower to be utilized as a simulated steam bath.

It is yet a further object of the instant invention to provide apparatus for use in a stall shower to simulate a steam bath which is simple in construction and which does not present any signifcant scalding hazard.

It is yet a further obhect of the instant invention to provide apparatus for simulating a live steam bath in a stall shower and for producing steam for an extended period of time from conventional sources of hot water, such as a home hot water heater.

These and other objects of this invention are achieved by providing apparatus for use in a stall shower to simulate a live steam bath. The apparatus comprises nozzle means to be mounted on the wall of said shower stall and coupled to a pipe carrying hot water. The nozzle means includes an orifice for producing an aerosol mist of a multitude of fine droplets of hot water in a well defined flat pattern. The nozzle is mounted with respect to the walls such that the spray pattern is directed at an angle to the walls to impinge the walls and produce a cloud of fine hot water droplets simulating live steam. The nozzle is constructed so as to produce a large volume of water droplets from a small volume of hot water.

In one embodiment of the invention the apparatus includes a diverter valve for converting a conventional stall shower having a shower head to a simulated steam bath while enabling the shower to be used in a conventional manner when desired. In another embodiment the apparatus is permanently built into the stall shower and includes conduit means extending through the wall and into fluid communication with a hot water pipe within the wall.

Other objects and many of the attendant advantages of this invention will be readily appreciated as the same becomes better understood by reference to the following detailed description when considered in connection with the accompanying drawing wherein.

Figure 1:
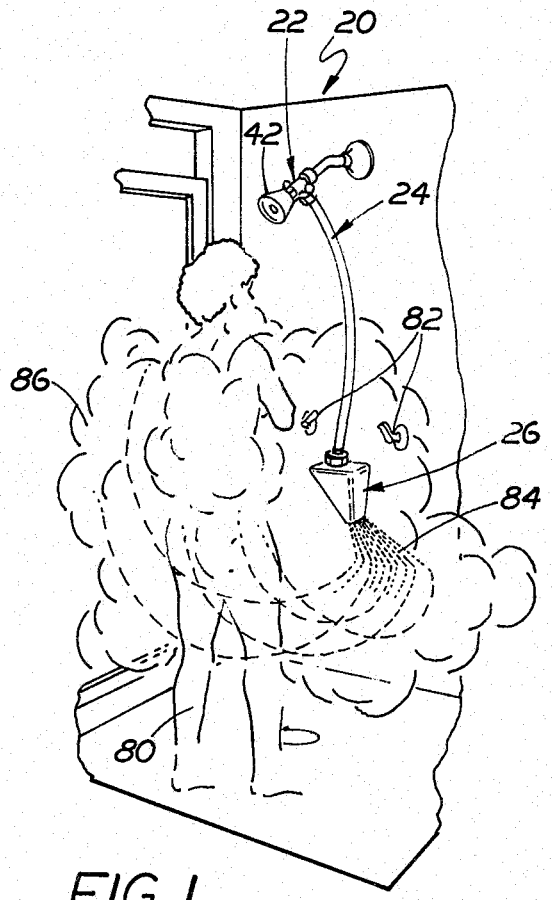
FIG. 1 is a perspective view of a stall shower including apparatus constructed in accordance with one embodiment of the instant invention for producing simulated live steam within the stall shower.

Referring now to the various figures of the drawing wherein like reference characters refer to like parts, there is shown in FIG. 1 one embodiment of a steam bath simulating device 20 in accordance with this invention.

The device 20 is particularly suited for connection in pre-existing stall showers 21 to enable such showers to be utilized as either a steam bath or as a conventional shower, as desired by the user.

The device 20 basically comprises a diverter valve 22 to which a flexible conduit or hose 24 is connected and a spray assembly 26 disposed at the free end of the hose 24. The spray assembly, as will be described in detail later, includes a nozzle 28 for producing an aerosol mist spray comprising a multitude of fine water droplets.

Figure 4A:
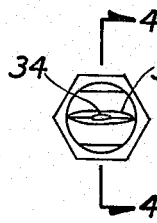
FIG. 4A is a front elevational view of a portion of the nozzle of the apparatus shown in FIG. 1.
Figure 4B:
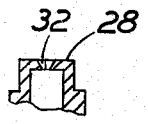
FIG. 4B is a side elevational view of a portion of the nozzle shown in FIG. 4A.
Figure 4C:
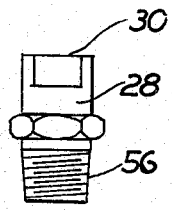
FIG. 4C is a side elevational view of the entire nozzle shown in FIGS. 4A and 4B.

In accordance with a preferred aspect of this invention the nozzle 28 is constructed so as to have a low flow rate. By low flow rate it is meant that the nozzle produces a relatively large volume of aerosol mist from a relatively small volume of water input, e.g., approximately 0.3 gallons per minute at 5 p.s.i. to approximately 1 gallon per minute at 40 p.s.i. In addition, and for reasons to be described hereinafter, it is preferred that the nozzle produce a flat spray pattern. It has been found that nozzles of the type disclosed in U.S. Pat. No. 2,621,078 (Wahlin) adequately accomplish the function of producing a flat spray pattern with a relatively low water flow rate. Other similar nozzles which may be utilized in the instant invention are disclosed in U.S. Pat. Nos. 2,693,627 (Wahlin) and 2,701,412 (Wahlin). The nozzle 28 shown herein (FIG. 4) includes an end face 30 having a small orifice 34 recessed therein at the bottom of a channel 32. The channel 32 extends across the end face 30 and coacts with the orifice 34 to form a flat, fan-shaped spray pattern.

The diverter valve 22 is of conventional construction and includes an input line 36 and a pair of output lines 38 and 40. The input line and the output lines are each in the form of passageways including threaded couplings. The valve is connected between a conventional spray shower head 42 and the pipe 44 supplying water thereto. To that end, the threaded coupling forming the water input 36 to the valve 22 is screwed into threaded engagement with the threaded free end of the pipe 44. The threaded coupling 38 forming one output of the valve 22 is screwed into threaded engagement with the threaded end of the shower head 42 while the threaded coupling 40 forming the other output of the valve 22 is screwed into threaded engagement with a threaded end of hose 24. The valve 22 includes internal means (not shown) to enable water to flow from pipe 44 to either the shower head 42 or to the hose 24 supplying the spray assembly 26. The selection of the desired output of the valve is accomplished via the positioning of dual-ended plunger 46. To that end, when the plunger 46 is pushed in the direction of arrow 48 in FIG. 3A to the position shown in solid lines therein, the valve 22 passes water therethrough to the shower head 42. When the plunger is pushed in the opposite direction (the direction of arrow 50) to the position shown in phantom lines in FIG. 3A, the valve passes water through the hose 24 to the steam simulating spray assembly 26 connected thereto.

Figure 5:
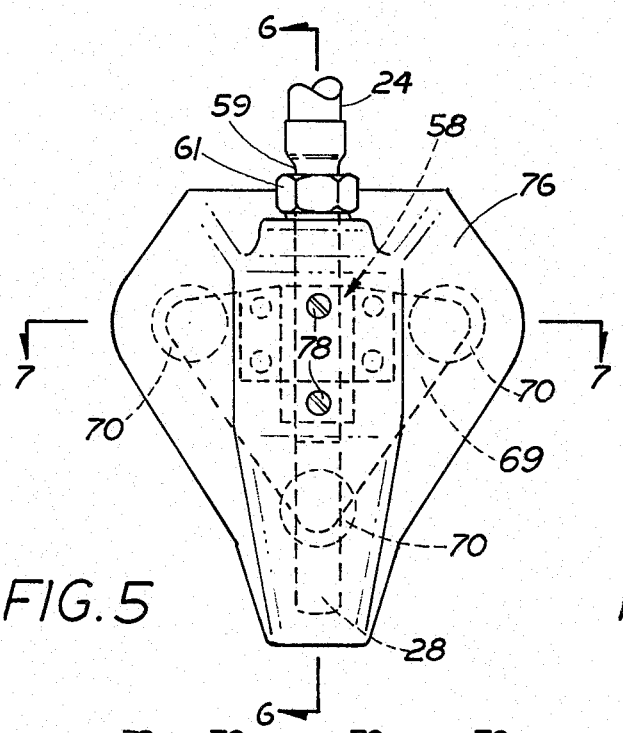
FIG. 5 is an enlarged front elevational view of a portion of the device shown in FIGS. 1 and 2.
Figure 6:
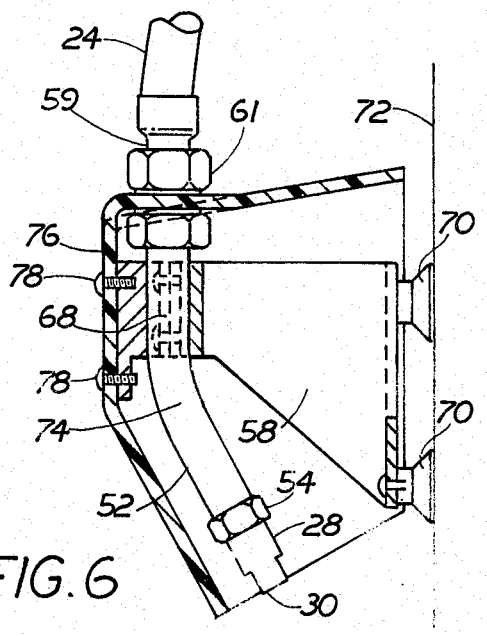
FIG. 6 is a sectional view taken along line 6—6 of FIG. 5.
Figure 7:
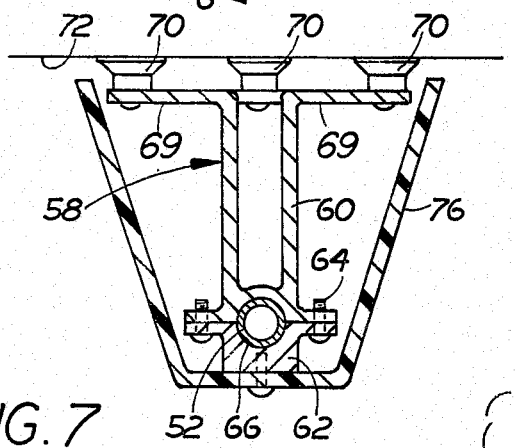
FIG. 7 is a sectional view taken along line 7—7 of FIG. 5.

The spray assembly 26 is shown clearly in FIGS. 5, 6 and 7. As can be seen therein, assembly 26 basically comprises an angular conduit 52 terminating in a threaded coupling 54 into which the threaded end 56 of nozzle 28 is screwed. The conduit 52 is mounted on a supporting bracket 58 and is in fluid engagement with the free end 59 of hose 24, via threaded coupling 61.

The bracket 58 is of a two-piece construction comprising components 60 and 62 which are bolted together, via bolts 64 (FIG. 7), and defines an opening 66 therebetween through which the straight portion 68 of conduit 52 extends. The conduit is held in place by the tight frictional engagement with the opening 66. The component 60 of bracket 58 include a triangular shaped planar mounting flange 69. Plural suction cups 70 are secured to the rear side of the flange at respective corners thereof. The suction cups serve as the means for securing the spray assembly 26 to the wall 72 of the stall shower 21 at any desired location.

As can be seen in FIG. 6, the free end portion 74 of the conduit 52 extends at an acute angle to the straight portion 68 thereof such that when the bracket 58 is secured to the wall 72 the nozzle 28 extends at a shallow acute angle to the wall (for reasons to be described later).

In order to protect the user from contact with the conduit 52, which may become quite hot as a result of the passage of hot water therethrough, a protective shroud 76 is mounted on the member 62 of bracket 60 via screws 78. The shroud is configured to cover virtually the entire spray assembly 26, only leaving the end face 30 of nozzle 28 uncovered and is preferably formed of a heat insulative material, e.g., plastic.

Figure 2:
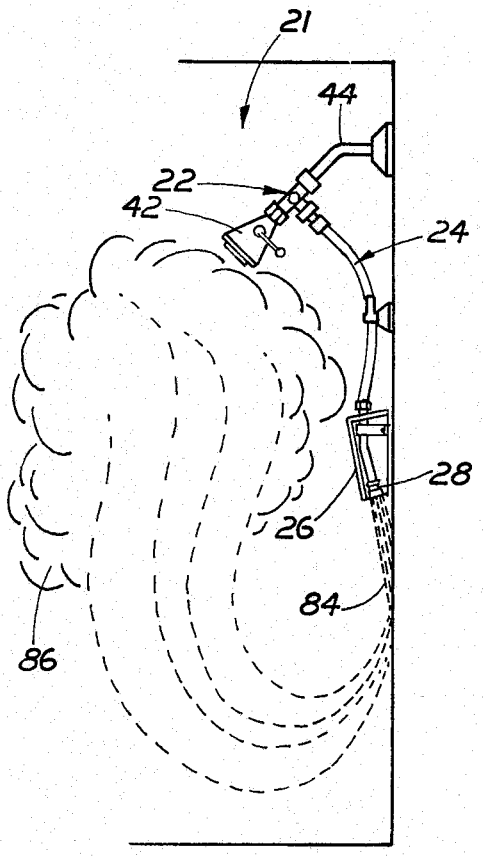
FIG. 2 is a side elevational view, partially in section, showing the apparatus of FIG. 1.
Figure 3A:
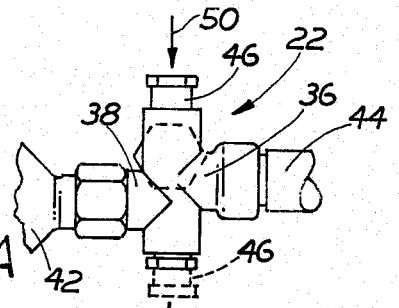
FIG. 3A is a top elevational view of a portion of the apparatus shown in FIGS. 1 and 2.
Figure 3B:
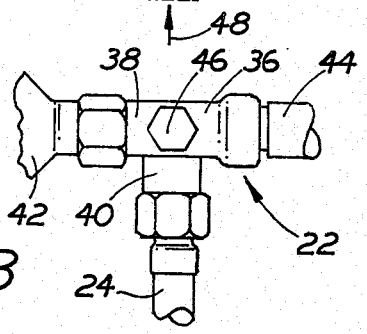
FIG. 3B is a side elevational view of the portion of the apparatus shown in FIG. 3A.

The device 20 operates as follows: when a user 80 (FIG. 1) wishes to take a steam bath within his stall shower 21, the plunger 46 of the diverter valve 22 is moved in the direction of arrow 48 to the full line position shown in FIG. 3A. Conventional temperature adjusting knobs 82, one for hot water and one for cold water, are adjusted in a conventional manner (the same manner as when taking a shower) to provide the desired temperature of hot water through pipe 44 and into the device 20. The hot water flowing through pipe 44 enters valve 22 at input 36 and exits the valve at outlet connection 40. The water then flows through the flexible hose 24 to the spray assembly 26. The hot water enters the spray assembly via coupling 61 and flows through conduit 52 exiting through orifice 32 of nozzle 28 in the form of a flat spray pattern 84 (FIGS. 1 and 2). The spray pattern is comprised of a multitude of fine droplets of hot water. The spray impinges the walls 72 of the shower 21, with the droplets being dispersed therefrom to form a cloud-like or aerosol mist 86 of fine water droplets simulating a cloud of live steam.

The feature of the spray impinging the wall of the shower stall is of considerable importance since it facilitates the formation of the simulated steam cloud 86 while at the same time precludes the hot spray stream 84 from making contact with the body of the user 80 immediately after being sprayed into the air, which action could result in the scalding of the user if extremely hot water were utilized.

The low flow rate of the nozzle 28 is also of considerable importance in the instant invention since it enables the user 80 to take a steam bath for an extended period of time without exhausting the home's water supply, which typically comprises a 40 gallon hot water tank. In this regard, it has been found that in typical use and with a forty gallon hot water tank, the device of the instant invention is operative for producing a simulated steam bath for between 1 hour and 1½ hours, depending upon the temperature of the water used and the water pressure. It should be pointed out at this juncture that all during the time of use the hot water tank will be building up heat in the cold water supplied to it, thereby extending the usable time of the device 20.

Figure 8:
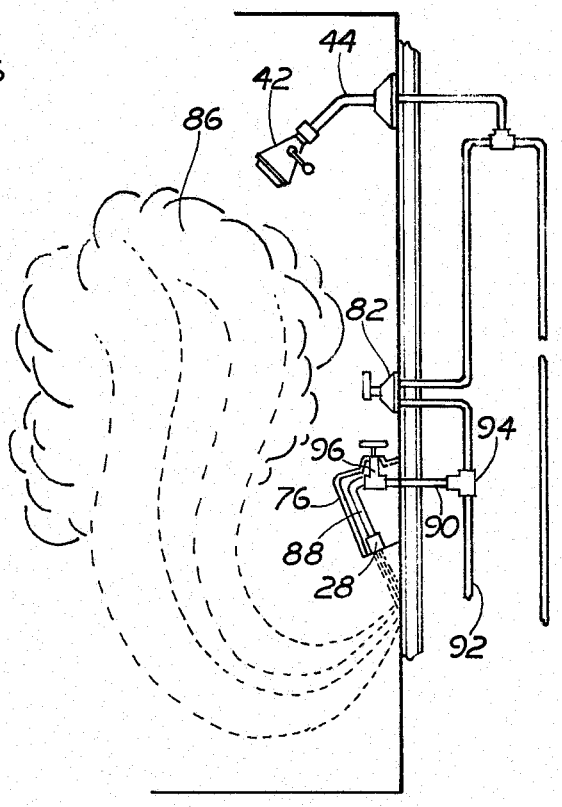
FIG. 8 is a side elevational view, partially in section, showing an alternative embodiment of the apparatus for use in the stall shower to simulate a live steam bath.

In FIG. 8 there is shown an alternative embodiment of the steam bath simulating device of the instant invention. To that end, in the embodiment shown in FIG. 8 the steam bath simulating device is made as a permanent fixture to the shower. To that end, the nozzle 28 is mounted on angularly extending end portion 88 of a conduit 90. The conduit 90 extends through the wall 72 of the stall shower 21 and is connected to the home's hot water pipe 92 via a T-joint 94. An adjustment valve 96 is connected in conduit 90. The valve 96 is operative to enable hot water to flow through conduit 90 to spray head 28 whereupon the liquid is broken into a flat spray pattern comprising a multitude of fine liquid droplets, which droplets impinge the wall 72 in the same manner as described heretofore to create the steam simulating cloud 86.

Without further elaboration, the foregoing will so fully illustrate my invention that others may, be applying current or future knowledge, readily adapt the same for use under various conditions of service.

What is claimed as the invention is:

1. Apparatus for use in a stall shower of a building to simulate a steam bath from hot water, comprising nozzle means, means mounting said nozzle means on a wall of said stall and means coupling said nozzle means to a pipe carrying the hot water supplied by said building, said nozzle means including an orifice for producing an aerosol mist of a multitude of fine droplets of hot water in a well defined flat spray pattern, and being constructed to have a low water flow rate to thereby produce a large volume of said fine water droplets from a small volume of water, said nozzle means being so mounted withrespect to said wall that the spray pattern is directed at an angle to the wall to impact the wall and produce a cloud of fine hot water droplets simulating live steam.

2. The apparatus of claim 1 wherein said apparatus is connected to a conventional shower head within said stall shower via the use of a diverter valve connected between said head and the pipe carrying water thereto.

3. The apparatus of claim 2 additionally comprising flexible hose means connected between said diverter valve and said nozzle means.

4. Apparatus for use in a stall shower of a building to simulate a live steam bath from hot water supplied by the building and carried in a pipe, said shower including a conventional shower head, said apparatus being connected by a diverter valve between said shower head and said pipe and comprising nozzle means, securement means for mounting said nozzle means on the wall of said stall, flexible hose means connected between said diverter valve and said nozzle means, and a protective shroud disposed over said nozzle means, said nozzle means including an orifice for producing an aerosol mist of a multitude of fine droplets of hot water in a well defined spray pattern, and being constructed to have a low water flow rate to thereby produce a large volume of said fine water droplets from a small volume of water, said nozzle being so mounted with respect to said wall that the spray pattern is directed at an angle to the wall to impact the wall and produce a cloud of fine hot water droplets simulating live steam.

* * * * *